US010703065B2

(12) United States Patent
Schalck

(10) Patent No.: US 10,703,065 B2
(45) Date of Patent: Jul. 7, 2020

(54) MACHINE FOR MANUFACTURING FLAT BOTTOM BAGS

(71) Applicant: Holweg Group, Molsheim (FR)

(72) Inventor: Vincent Schalck, Holtzheim (FR)

(73) Assignee: HOLWEG GROUP, Molsheim (FR)

( * ) Notice: Subject to any disclaimer, the term of this patent is extended or adjusted under 35 U.S.C. 154(b) by 507 days.

(21) Appl. No.: 14/408,050

(22) PCT Filed: Jun. 6, 2013

(86) PCT No.: PCT/FR2013/051295
§ 371 (c)(1),
(2) Date: Dec. 15, 2014

(87) PCT Pub. No.: WO2013/190208
PCT Pub. Date: Dec. 27, 2013

(65) Prior Publication Data

US 2015/0141228 A1 May 21, 2015

(30) Foreign Application Priority Data

Jun. 20, 2012 (FR) ..... 12 55766

(51) Int. Cl.
*B31B 70/00* (2017.01)
*B31B 155/00* (2017.01)
(Continued)

(52) U.S. Cl.
CPC ..... *B31B 70/00* (2017.08); *B31B 70/024* (2017.08); *B31B 70/261* (2017.08);
(Continued)

(58) Field of Classification Search
CPC ..... B31B 29/00; B31B 19/00; B31B 19/29; B31B 2219/028; B31B 2219/2672;
(Continued)

(56) References Cited

U.S. PATENT DOCUMENTS 3,379,103 A * 4/1968 Treff ..... B31B 19/00 493/12
3,554,099 A * 1/1971 Rodley ..... B31F 1/10 493/187
(Continued)

FOREIGN PATENT DOCUMENTS

DE 10261257 7/2004
EP 1525976 4/2005
(Continued)

OTHER PUBLICATIONS

Bals & Vogel—Third Party Notice of Opposition (23 pages with English translation) dated Mar. 21, 2017 out of corresponding European Patent No. EP2864114.
(Continued)

*Primary Examiner* — Sameh Tawfik
(74) *Attorney, Agent, or Firm* — Brinks Gilson & Lione; John C. Freeman

(57) ABSTRACT

A machine for manufacturing flat bottom bags includes a drum for carrying along at least one blank having a flattened tubular shape in an advancing direction, a first scoring apparatus upstream of the drum for marking on the blank a first folding line which is transverse with respect to the advancing direction, a front gripper on the drum that grips a front edge of the blank on the drum, in an opening step, and and carries along the blank, a first lateral gripping means on the drum that grip the lateral edges of the blank in the region of the first folding line.

9 Claims, 5 Drawing Sheets

(51) Int. Cl.

| | |
|---|---|
| *B31B 70/02* | (2017.01) |
| *B31B 70/26* | (2017.01) |
| *B31B 160/20* | (2017.01) |
| *B31B 150/00* | (2017.01) |
| *B31B 160/10* | (2017.01) |

(52) U.S. Cl.
CPC ..... *B31B 2150/00* (2017.08); *B31B 2150/003* (2017.08); *B31B 2155/00* (2017.08); *B31B 2155/003* (2017.08); *B31B 2160/10* (2017.08); *B31B 2160/20* (2017.08)

(58) Field of Classification Search
CPC ..... B31B 2221/20; B31B 2221/60; B31B 2237/20; B31B 2237/60; B31B 70/00; B31B 70/024; B31B 2150/00; B31B 2155/00; B31B 2150/003; B31B 2160/20; B31B 70/261; B31B 2155/003; B31B 2160/10
USPC ..... 493/241
See application file for complete search history.

(56) References Cited

U.S. PATENT DOCUMENTS

| | | | | |
|---|---|---|---|---|
| 3,710,694 | A * | 1/1973 | Ehlscheid | B31B 19/00 493/243 |
| 4,380,446 | A * | 4/1983 | Dickson | B29C 65/18 493/11 |
| 4,934,993 | A * | 6/1990 | Gietman, Jr. | B31B 19/00 493/11 |
| 5,149,315 | A * | 9/1992 | Muhs | B31B 19/00 493/189 |
| 6,283,906 | B1 * | 9/2001 | Kostiza | B65H 45/163 493/424 |
| 6,511,409 | B2 * | 1/2003 | Hachiya | B65H 45/163 493/3 |
| 7,011,617 | B2 * | 3/2006 | Sappal | B65H 45/163 493/424 |

FOREIGN PATENT DOCUMENTS

| | | |
|---|---|---|
| FR | 1 383 234 | 12/1964 |
| GB | 918381 | 2/1963 |
| GB | 1369457 | 10/1974 |

OTHER PUBLICATIONS

EPO Notice of Opposition (7 pages) dated Apr. 26, 2017 out of corresponding European Patent No. EP2864114.

PCT/FR2013/051295 International Search Report dated Oct. 4, 2013 (4 pages including English translation).

* cited by examiner

MACHINE FOR MANUFACTURING FLAT BOTTOM BAGS

This application claims priority to International Application No. PCT/FR2013/051295 filed Jun. 6, 2013; and French Application No. 1255766 filed Jun. 20, 2012; the entire contents of each are incorporated herein by reference.

BACKGROUND

The invention relates to a machine for making flat bottom bags, in particular paper bags, of the type including a drum onto which a blank bag is driven and follows various folding and gluing operations in order to form the bag.

Flat bottom bags have been known for many years now, used for example to carry provisions or shopping in stores. Such a bag comprises a tubular envelope closed at one end by a flat bottom. The flat bottom is obtained by the pressing, the folding down of the flaps from the envelope and the gluing of these flaps together.

The manufacture of these bags has been more or less automated and according to various techniques. One of them is detailed, for example, in document U.S. Pat. No. 3,554,099. The machine described in this document shows that a blank is first of all formed and presents two skins connected together along two opposite edges by two bellows. The blank is placed flat on a table, one of the skins, called the lower skin, being against the table, the other skin being above and the bellows being pressed down between the two skins. The blank is driven in translation on the table in a direction parallel to the bellows towards a peripheral drum from which various stations are distributed.

First scoring means make a first fold line at the bellows, and a second fold line at a predetermined distance from the first line, in a direction perpendicular to the bellows. The scoring means comprise a rotary blade holder and additional slots carried by a counter-rotating drum. As it progresses, the front of the blank is gripped between the drum and a roller. The drum comprises front pinching means to drive the blank by pinching the front edge of the lower skin. To facilitate the separation of the two skins, the opening roller includes suction means which maintain the upper skin against the roller after it has passed between the roller and the drum. Set back in relation to the front pinching means, first lateral pinching means pinch the lateral edge of the blank at the junction between the bellows and the lower skin. Symmetrically, two pinching means pinch the lateral edge of the blank at the junction between the bellows and the upper skin. When the blank continues to pass between the roller and the drum, the lateral pinching means move away from each other, opening the blank and forming a fold on the bellows in a radial plane of the drum and the roller. The two pinching means release the blank whilst in the continuation of the movement of the drum which drives the blank, spatulas press down the open part towards the centre. The upper skin is folded towards the rear at the second fold line.

In the continuation of the operations, second scoring means mark two transverse lines, on either side of the second fold line. One of these lines coincides with the first fold line. Then, adhesive is applied to the two flaps delimited by these fold lines and they are pressed down one onto the other to close the flat bottom and thus form the bag.

Such a machine allows a high production rate to be attained as all the manufacturing operations are automated. However, it is designed for a single bag format. When another format is to be produced, many parts must be changed and laborious adjustments must be made. Also, certain characteristics of the bag produced depend on the production rate in such a way that it is difficult to anticipate these characteristics by an adjustment when the machine is stopped. The characteristics must be checked when the machine is in operation, then new adjustments must be done on the stopped machine before a new validation in operation.

The aim of the invention is therefore to provide a machine for making flat bottom bags allowing the bag format to be changed very rapidly and easy adjustment of the characteristics of the bags produced.

SUMMARY

With these targets in mind, the object of the invention is a machine for making flat bottom bags, comprising a drum to drive at least a blank of flattened tubular form in a direction of advance, first scoring means upstream of the drum to mark on the blank a first transverse fold line in relation to the direction of advance, front pinching means on the drum to pinch a front edge of the blank on the drum, in an opening stage, and to drive the blank, from the first lateral pinching means on the drum to pinch the lateral edges of the blank at the first fold line, the machine being characterised in that it comprises first adjustment means to adjust in operation both the distance between the front edge and the first fold line and the relative angular position of the front pinching means and of the first lateral pinching means.

The position of the first fold line in relation to the front edge of the blank is related to the position of the first lateral pinching means which must pinch the blank in the alignment of this first fold. By changing these two characteristics in a synchronous manner, this characteristic can be adjusted in operation. By allowing one of the characteristics of the flat bottom bag to be adjusted in operation, means are thus provided which do not require the stoppage of the machine to observe the effect of the adjustment directly on the manufactured product. The adjustment time is thus reduced and the quantity of bags produced during the adjustment phase is reduced.

According to a constructive arrangement, the drum comprises a first element carrying the front pinching means, a second element carrying the first lateral pinching means pivotally mounted in relation to the first element around the rotational axis of the drum, the first adjustment means determining the relative angular position between the first and the second element. As the first element and the second element can be offset angularly, the relative position of the front pinching means and of the lateral pinching means can be adjusted. The offset can be obtained by a relative actuation between the two elements. It can also be obtained by each being driven by the same motor, the first adjustment means comprising a reduction gear allowing an angular offset to be introduced between the drive of each of the two elements. Such a reduction gear comprises, for example, two planetary gear wheels of same axis, each wheel meshing with a satellite, the satellites being attached to the same rotation shaft. The reduction ratios between one and the other of the wheel/satellite pairs are different. The satellite axle is rotatively mounted on a satellite holder, which is pivotally mounted around the same rotation axis as the planetary gears. One of the planetary gears receives the movement from the motor, whereas the second planetary gear transmits the movement to one of the drum elements. The difference in the reduction ratio introduced by the two planetary/satellite gear pairs is compensated for by an adaptor so that the two elements are finally driven at the same speed. By modifying the position of the satellite holder, an offset is introduced into the drive movement between the two elements and these are angularly offset.

According to an improvement, the first scoring means are provided to mark in addition a second fold line on the bag at a distance from the first fold line, the machine comprising second adjustment means to adjust in operation the distance between the first and second fold line. The second fold line corresponds to a fold of the upper skin which will be pressed down around this line towards the rear as in the prior art described previously. The distance with the first fold line corresponds to half of the dimension of the flat bottom in the direction of advance. The second adjustment means allow another characteristic of the bag to be modified, that is the position of the press down at the rear of the upper skin.

In a complementary manner, the machine comprises second scoring means to mark, after the opening stage, a third fold line on the blank, the second adjustment means being provided to adjust, in addition, the distance between the first and third fold line so that the second fold line will be at mid-distance between the first and the third fold line. The third fold line marks the limit of the flat bottom and around which a flap will be pressed down forwards. The adjustment of the position of this third line allows the adjustment of the dimension of the flat bottom to be completed in the direction of advance in a synchronised manner with the position of the second fold line.

According to a complementary arrangement, the two scoring means are provided to mark a fourth fold line at the same location on the blank as the first fold line. The part included between the front edge of the blank and this fourth fold line being pressed down rearwards in a subsequent operation in such a way that the flat bottom will be delimited by the third and fourth fold line.

According to a constructive arrangement, the two scoring means comprise a first die on a third drum element to mark the third fold line, the third element being pivotally mounted in relation to the second element around the drum rotational axis, the two adjustment means determining the relative angular position between the second and the third element. The first die is capable of receiving a blade which pushes back the blank into the die to make the scoring, in a manner known itself. The relative position of the second and the third element can be adjusted in the same way as the relative position between the first and the second element, that is with similar components.

In a complementary manner, the second scoring means comprise a second die on the second element to mark the fourth fold line. The first fold line is maintained by the first pinching means on the second element. The second die is therefore placed on the second element to make the fourth fold line at the same location as the first fold line.

According to a constructive arrangement, the first scoring means comprise a first marker roller and a counter-roller which are counter-rotative with rotational axes parallel to that of the drum and placed on either side of a trajectory for the blanks, the first marker roller comprising a first blade and a second blade extending parallel to the rotational axis to respectively mark the first and the second fold line by pinching between the blade and the counter-roller, the angular difference between the blades being adjustable by the second adjustment means. The adjustment of the angular difference between the first and the second blade on the first marker roller allows the distance between the first and the second fold line to be adjusted. The counter-roller allows the blank to be accompanied during the blade scoring operation.

In a complementary manner, the counter-roller comprises a first and a second peripheral indent, the indents extending parallel to the rotational axis of the counter-roller, the relative angular position of the indent being adjusted by the second adjustment means so that the blades do the scoring of the fold lines by pushing the blank against the respective indent.

According to another constructive characteristic, the machine comprises an opening roller to open the blank, the roller being placed opposite the drum downstream of the first scoring means, the opening roller being rotative around an axis parallel to that of the drum in an opposite direction, the opening roller comprising at least one sucker to suck and move away an upper skin of the blank outer side at the drum near to the front edge. Means are thus provided to separate the upper skin from the lower skin and place the front pinching means to pinch the front edge of the lower skin of the blank.

According to an improvement, the opening roller in addition comprises two lateral pinching means substantially on the same generatrix as the sucker to grip the lateral edges of the blank and to tension the blank between the first and second pinching means. The first and second lateral pinching means cooperate to deploy the bellows and tension them along a line which has been marked previously with the first fold line. The second pinching means are controlled to release the blank when the bellows are tensioned. These are then maintained in place by the rigidity conferred by the bellows fold line.

Other advantages may again appear to a person skilled in the art on reading the examples below, illustrated by the appended figures, given for illustration purposes.

DETAILED DESCRIPTION

Figure 6:
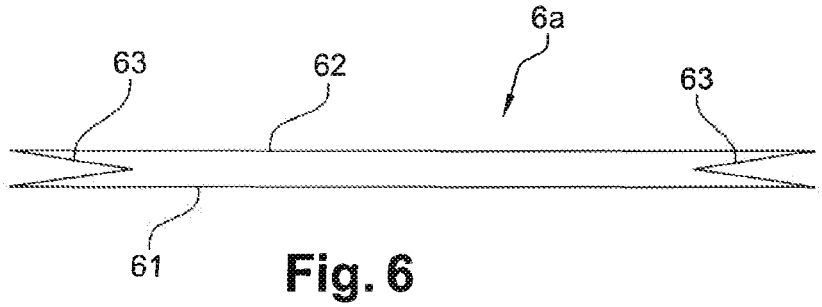
FIGS. 6 to 11 are perspective views of the bag blank at different manufacturing stages.

An installation for making flat bottom bags comprises in a classical manner a feed roller 1 of a reel B of film such as paper, a take-up device 2 to store a strip of unwound film, an envelope forming machine 3, a cutting device 4 and a machine 5 for forming flat bottom bags 6. A stacking device, not shown, can also be provided to receive the bags produced and form stacks. The envelope forming machine 3 folds the strip to join and glue the two edges together. At outlet, the envelope has two skins 61, 62 connected together along two opposite edges by two bellows 63. The cutting machine 4 makes a transverse cut of the envelope to form blanks **6*a* with a constant transverse section, therefore of tubular form, as shown on FIG. 6. The blank 6*a* is presented with the bellows 63 folded between the two skins 61, 62 thus with a flattened form. In a conventional manner, it is considered that one of the skins 61 is the lower skin and the other the upper skin 62. The blank is identified below by reference 6 completed by a letter to distinguish between the various bag 6** manufacturing stages.

The machine 5 forming bags 6 comprises a drum 50 rotationally mounted around a drum transverse axis A and on the periphery of which the blank 6*a* is gripped and submitted to the transformations detailed below. The blank follows a path in the machine which in part follows the periphery of the drum 50 in a so-called direction of advance.

Figure 4:
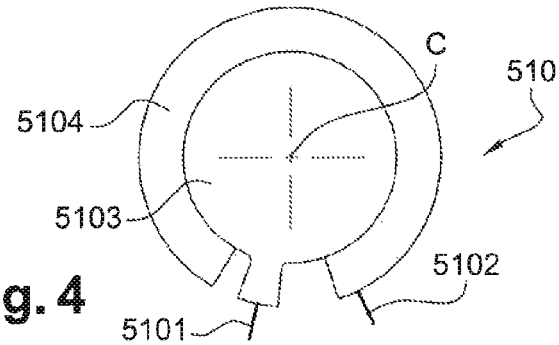
FIG. 4 is a cross-sectional view of the first scoring means.
Figure 3:
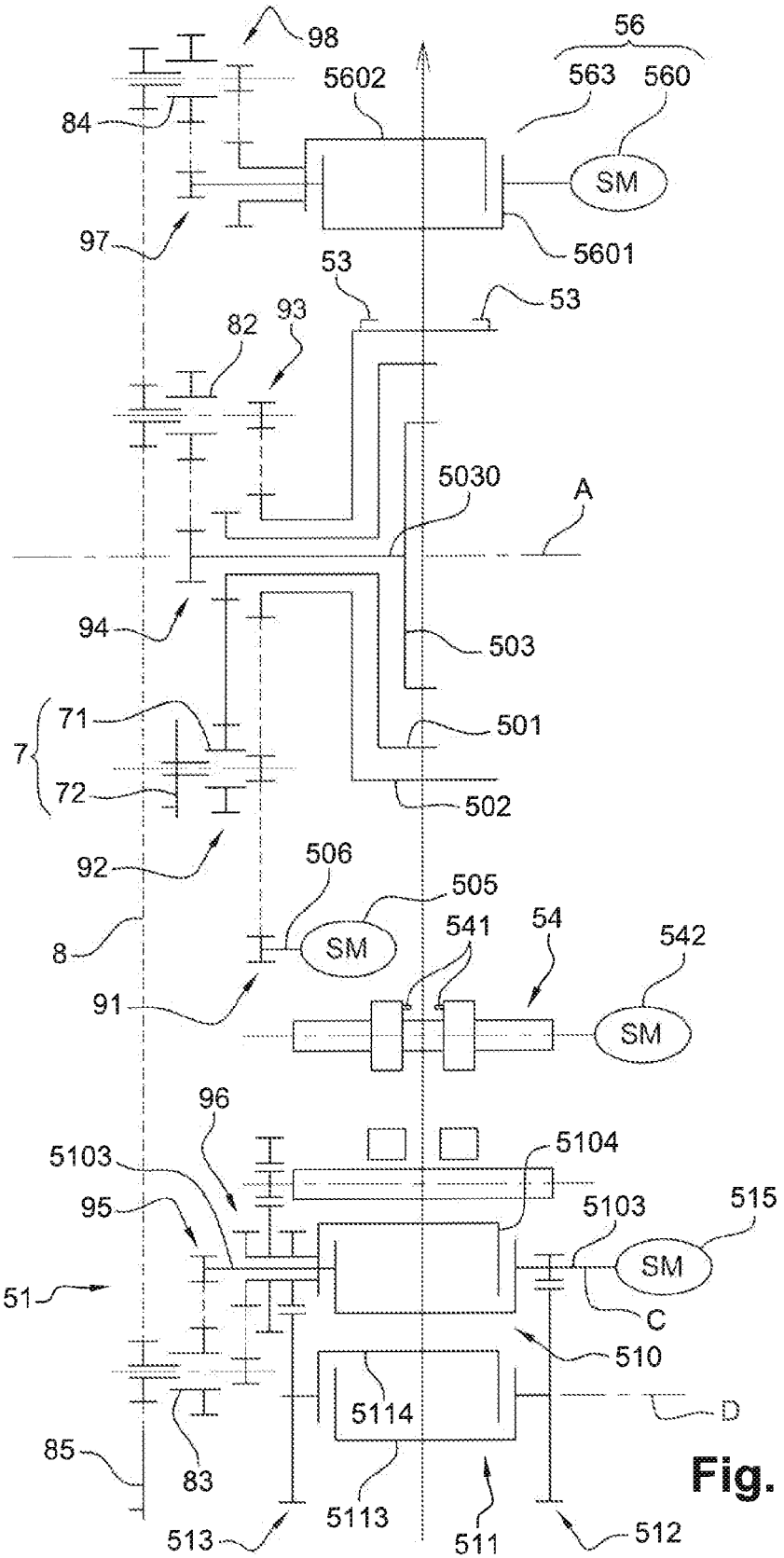
FIG. 3 is a kinematic diagram of the elements of the machine of FIG. 2.
Figure 7:
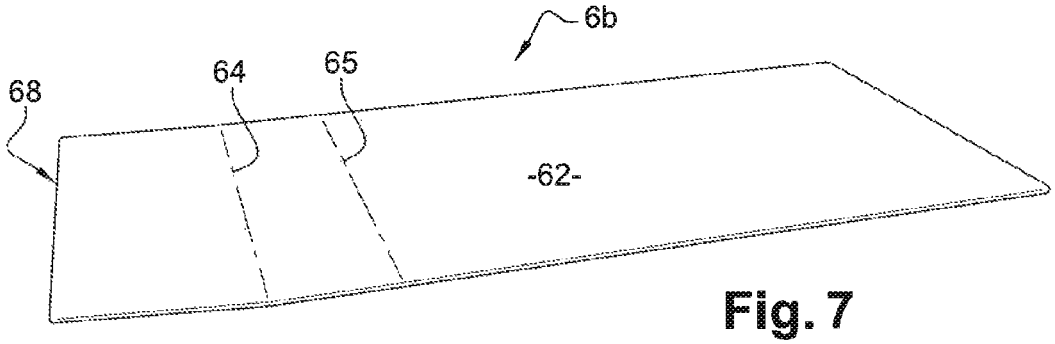

The machine 5 first comprises in the direction of the path first scoring means 51 upstream of the drum 50. The first scoring means 51 comprise a first marker roller 510 and a counter-roller 511 which are counter-rotative with rotational axes C, D parallel to the axis of the drum 50 and placed on either side of the path of the blanks 6*a*. The first marker roller 510 comprising a first blade 5101 and a second blade 5102 extending parallel to the rotational axis C to respectively mark a first and a second fold line on the blank 6*b* by pinching between the blade 5101, 5102 and the counter-roller 511. As shown on the detail of FIG. 4, the first marker roller 510 comprises a centre shaft 5103 inserted into a partially open tube 5104. The centre shaft 5103 carries the first blade 5101 whereas the tube carries the second blade 5102. The first blade 5101 protrudes from the periphery of the tube passing via the open part of the tube 5104. The tube 5104 is pivotally mounted on the centre shaft 5103 in such a way that the angular difference between the blades 5101, 5102 is adjustable, in a manner detailed below. The counter-roller 511 also comprises a centre shaft and a partially open tube which respectively carry a first indent 5111 and a second indent 5112 extending parallel to the rotational axis of the counter-roller 511. The first indent 5111 is carried by a quadrant which is flush with the periphery of the tube and which protrudes into the open part of the tube. The first blade 5101 in cooperation with the first indent 5111 allow the first fold line 64 transverse in relation to the direction of advance to be marked on the blank at a predetermined distance from the front edge 68 of the blank 6*b*, whereas the second blade 5102 in cooperation with the second indent 5112 allow a second fold line 65, parallel to the first fold line 64, to be marked on the blank 6*b* at a distance from the front edge 68 higher than the first fold line 64, as shown on FIG. 7.

Figure 1:
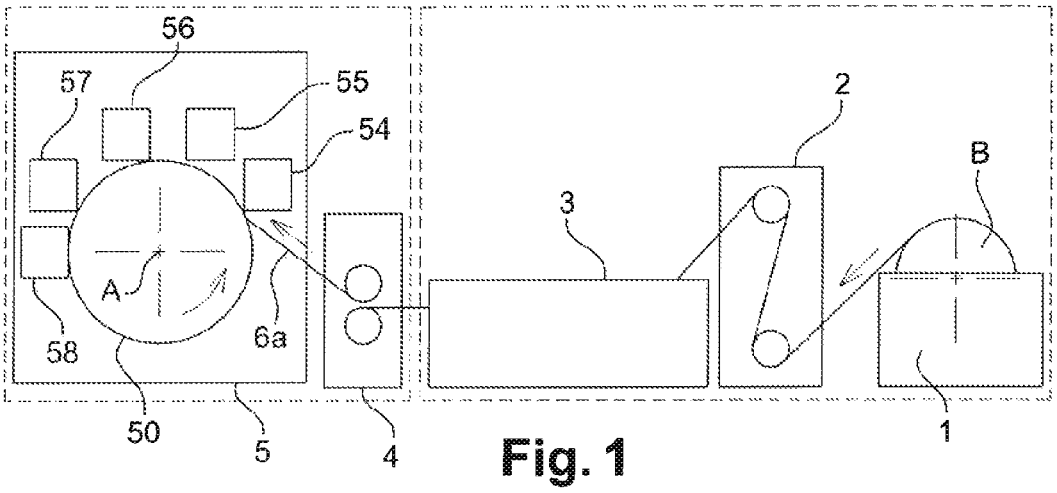
FIG. 1 is a schematic view of an installation for making flat bottom bags according to the invention.
Figure 2:
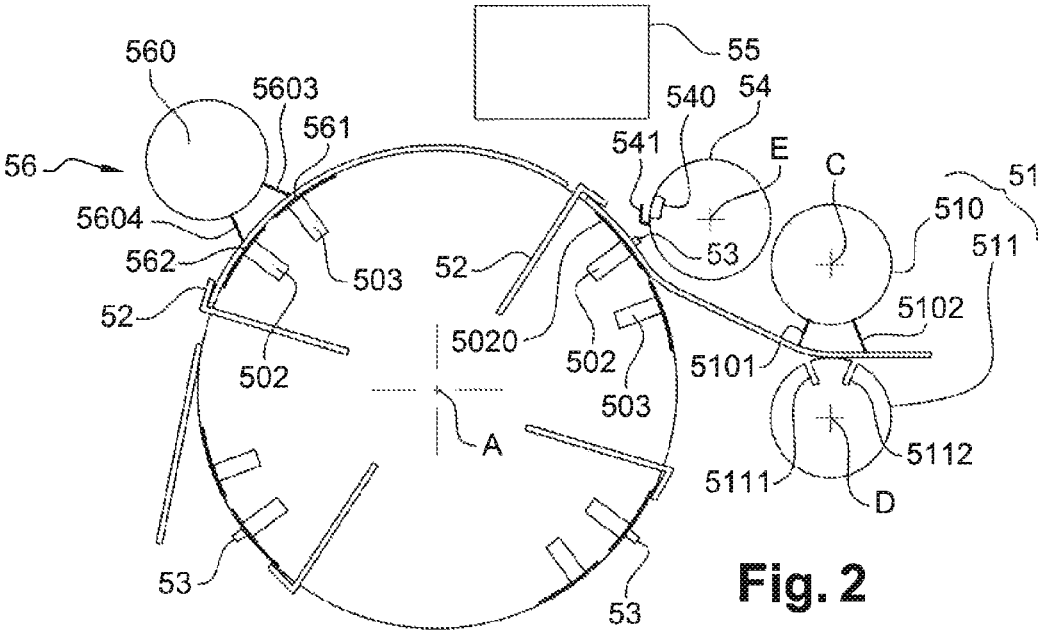
FIG. 2 is a schematic view of a machine for making flat bottom bags in compliance with the invention.

The drum 50 is formed by three elements 501, 502, 503, each pivoting in relation to the other. Each element is driven by a shaft with drum axis 50 as axis. Each element also comprises four regularly spaced branches in order to form four stations for the transformation of the blank as shown on FIG. 2. Thus, on reach rotation of the drum 50, four bags 6 are formed, one per station.

Each station comprises front pinching means 52 carried by the first element 501 of the drum 50 to pinch a front edge 68 of the blank on the drum 50, in an opening stage, and drive the blank. The second element 502 of the drum 50 carries first lateral pinching means 53 to pinch the lateral edges of the blank 6*b* at the first fold line 64.

The machine 5 comprises an opening roller 54 to open the blank 6*b*. It is placed opposite the drum 50 downstream of the first scoring means 51, tangent to the path followed by the blank 6*b*. The opening roller 54 rotates around an axis E parallel to that of the drum 50 in an opposite direction. The opening roller 54 comprises at least one sucker 540 to suck and move away the upper skin 62 of the blank 6*b* on outer side of the drum 50 near to the front edge 68. The opening roller 54 is driven by a specific motor 542 with a variable speed during a given rotation. The opening roller 54 also comprises second lateral pinching means 541 substantially on the same generatrix as the sucker 540 to grip the lateral edges of the blank and to tension the blank between the first and second lateral pinching means 53, 541. The pinching means 52, 53, 541 are controlled to grip and release the blank 6*c* at positions detailed below.

The machine 5 also comprises spatulas 55 which are placed in a fixed manner, on the periphery of the drum 50, tangent to the drum 50, oriented in a pinching direction in the movement of the drum 50. The second element 502 has a table 5020 of semi-cylindrical form adjusted to the periphery of the drum 50, the table 5020 being drilled with suction holes connected to a suction line, not shown. A distributor controls the communication between the holes and the line to cut the suction when the bag must leave the drum 50.

The machine 5 also comprises second scoring means 56 to mark, after the opening stage, a third and a fourth fold line 66, 67 on the blank 6. The third fold line 66 is placed symmetrical to the first fold line 64 in relation to the second fold line 65. The fourth fold line 67 passes via the same location as the first fold line 64 in order to mark the parts of the blank which have been pressed down over the first fold line 64. The second scoring means 56 comprise a second marker roller 560 of same composition as the first marker roller 510 and comprising a third and fourth blade 5603, 5604 carried respectively by a shaft 5601 and a tube 5602. The second scoring means 56 also comprise a first die 561 on the third element 503 of the drum 50 to mark the third fold line 66 in cooperation with the third blade 5603 and a second die 562 on the second element 502 of the drum 50 to mark the fourth fold line 67 in cooperation with the fourth blade 5604. The second die 562 comprises tightening means, not shown, to pinch the blank along the fourth fold line 67.

The machine 5 also comprises downstream of the second marker roller 560 an adhesive application station 57 and two press down stations 58 which will not be detailed here.

In order to do an adjustment in operation of certain bag characteristics, the machine 5 comprises first adjustment means 7 and second adjustment means 8. The first adjustment means 7 are provided to adjust in operation both the distance between the front edge 68 and the first fold line 64 and the relative angular position on the drum 50 of front pinching means 52 and lateral pinching means 53. The second adjustment means 8 are provided to adjust also in operation the distance between the first and the third fold line 65, 66 so that the second fold line 65 will be at mid-distance between the first and the third fold line 64, 66.

In detail, the first adjustment means 7 determine the relative angular position between the first and the second element 501, 502. For this, a drum motor 505 drives a main shaft 506, which is connected to the second element 502 by a first set 91 of pulleys and a notched belt. The first element 501 is driven by the main shaft 506 by means of a first reduction gear 71 belonging to the first adjustment means 71.

Figure 5:
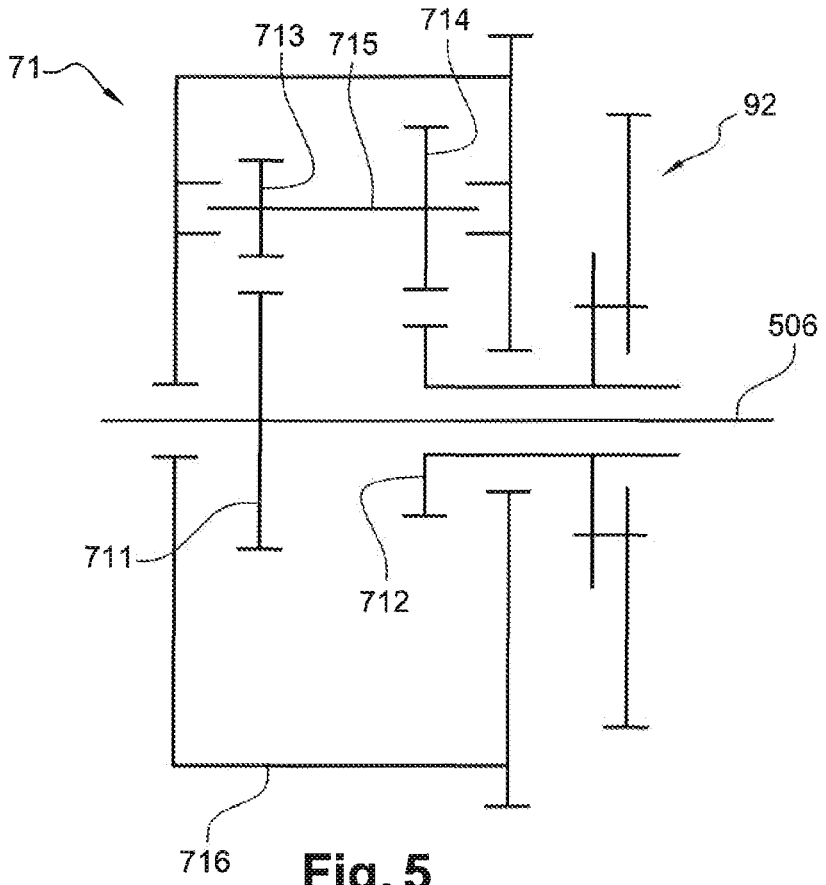
FIG. 5 is a schematic view of a reduction gear used for the adjustment means.

By referring to FIG. 5, which shows in a schematic and general manner the composition of the first reduction gear 71, it can be seen that the reduction gear comprises two planetary gear wheels 711, 712 with same rotational axis, each wheel 711, 712 meshing with a satellite 713, 714, the satellites being attached to the same rotation shaft 715. The reduction ratios between one and the other of the wheel/satellite pairs are different. The shaft 715 of the satellites is rotationally mounted on a satellite holder 716, which is pivotally mounted around the same rotational axis as the planetary gears 711, 712. If:

Z1 is the number of teeth of the first planetary gear 711;

Z2 is the number of teeth of the secondary planetary gear 712;

Za is the number of teeth of the satellite or satellites 713 of the first planetary gear 711;

Zb is the number of teeth of the satellite or satellites 714 of the second planetary gear 712;

and $$\rho = \frac{Z_1 \cdot Z_b}{Z_2 \cdot Z_a},$$

then, when the satellite holder 716 is stationary, $\omega_2=\rho.\omega_1$, where ω2 and ω2 are the rotational speeds of the first and second planetary gear 711, 712 respectively. When the first planetary gear 711 is stopped, the rotation of the satellite holder 716 drives the rotation of the second planetary gear 712 according to the following relation:

$$\omega_2=(1-\rho).\omega_{ps}$$

where $\omega_{ps}$ is the rotational speed of the satellite holder 716. In this relation, it can be seen that an angular offset between the elements driven respectively by the first and second planetary gear 711, 712 can be obtained by turning the satellite holder 716. This angular offset is produced, even if the drum is rotating.

In the setup of the first reduction gear 71, the first planetary gear 711 is directly driven by the main shaft 506, the second planetary gear 712 is connected to the first element 501 by means of a second set 92 of two pulleys and a notched belt. The satellite holder 716 is connected to a control knob 72 which can be operated manually to determine the relative angular position between the first and the second element 502. The various transmission ratios between the main shaft 506 and the second element 502, and that of the first reduction gear 71 and of the second set 92 of pulleys and belt are chosen so that the first element 501 and the second element 502 rotate at the same speed.

So that the second adjustment means 8 can adjust in operation the distance between the first and the second fold line 64, 65, they in particular determine the relative angular position between the second and the third element 502, 503. For this, a third set 93 of pulleys connects the main shaft 506 to the first planetary gear of a second reduction gear 82 similar to the first reduction gear 71. The second planetary gear is connected by a fourth set 94 of pulleys and belt to a shaft 5030 of the third element 503. The various transmission ratios are also chosen so that the third element 503 is driven at the same speed as the first and the second element 502. The satellite holder of the second reduction gear 82 is normally stationary, but it can be pivoted to introduce an angular offset between the main shaft 506 and the shaft 5030 of the third element 503. It is connected to a second control knob 85 which can be operated manually.

The second adjustment means 8 in addition allow the angular difference to be adjusted between the blades 5101, 5102 of the first marker roller 510 of the first scoring means 51 and thus the angular difference between the first and the second indent 5111, 5112 of the counter roller 511. For this, the centre shaft 5103 of the first marker roller 510 is connected to the centre shaft 5113 of the counter roller 511 by a first pair of gears in such a way that the roller and the counter roller 511 are counter rotative and always synchronised in such a way that the first blade 5101 and the second indent 5111 coincide during the rotation. Also, the tube 5104 of the first marker roller 510 is connected to the tube 5114 of the counter roller 511 by a second pair of gears 513 in such a way that the second blade 5102 and the second indent 5112 coincide during the rotation. In addition, a third reduction gear 83, similar to the first reduction gear 71, connects the centre shaft 5103 and the tube 5104 of the first marker roller 510. The centre shaft 5103 is connected by a fifth set 95 of pulleys and belt to the first planetary gear of the third reduction gear 83, whereas the tube 5104 is connected by a sixth set 96 of pulleys and belt to the second planetary gear of the third reduction gear 83. The satellite holder of the third reduction gear 830 is controlled by the second control knob. The transmission ratios of the third reduction gear 83, of the fifth and of the sixth set 95, 96 of pulleys and belt are chosen so that when the satellite holder is stationary, the centre shaft 5103 and the tube 5104 of the first marker roller 510 rotate at the same speed. The pivoting of the satellite holder of the third reduction gear 83 induces an angular offset between the centre shafts 5103, 5113 and the tubes 5104, 5114 of the first marker roller 510 and of the counter roller 511. The centre shaft 5103 is driven by a first scoring motor 515.

The second adjustment means 8 also allow the angular difference between the blades 5603, 5604 of the second scoring means 56 to be adjusted. For this, a fourth reduction gear 84, similar to the first reduction gear 71, connects the centre shaft 5601 and the tube 5602 of the second marker roller 560. The centre shaft 5601 is connected by a seventh set 97 of pulleys and belt to the first planetary gear of the fourth reduction gear 84, whereas the tube 5602 is connected by an eighth set 98 of pulleys and belt to the second planetary gear of the fourth reduction gear 84. The satellite holder of the fourth reduction gear 84 is controlled by the second control knob. The transmission ratios of the fourth reduction gear 84, of the seventh and eighth set 97, 98 of pulleys and belt are chosen so that when the satellite holder is stationary, the shaft 5601 and the tube 5602 of the second marker roller 560 rotate at the same speed. The pivoting of the satellite holder of the fourth reduction gear 84 induces an angular offset between the shaft and the tube of the second marker roller 560. The centre shaft 5601 is driven by a second scoring motor 563.

Operation

During the operation of the machine 5 for making flat bottom bags, the main motor 505 drives the drum 50 at a constant speed, except during transitory phases. The first and the second scoring means 51, 56 and the opening roller 54 are rotationally driven by their own respective motors 515, 563, but in a synchronised speed and position manner in relation to the drum 50. The synchronisation is done for example electronically. The marker rollers 510, 560 and the opening roller 54 rotate in the opposite direction to the drum 50, whereas the counter roller 511 rotates in the same direction.

Figure 8:
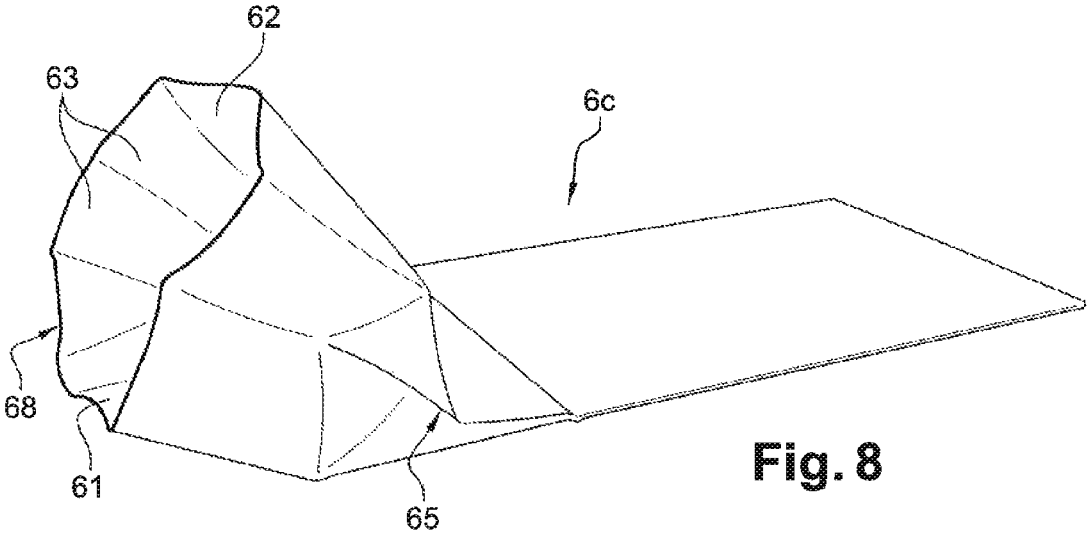
Figure 9:
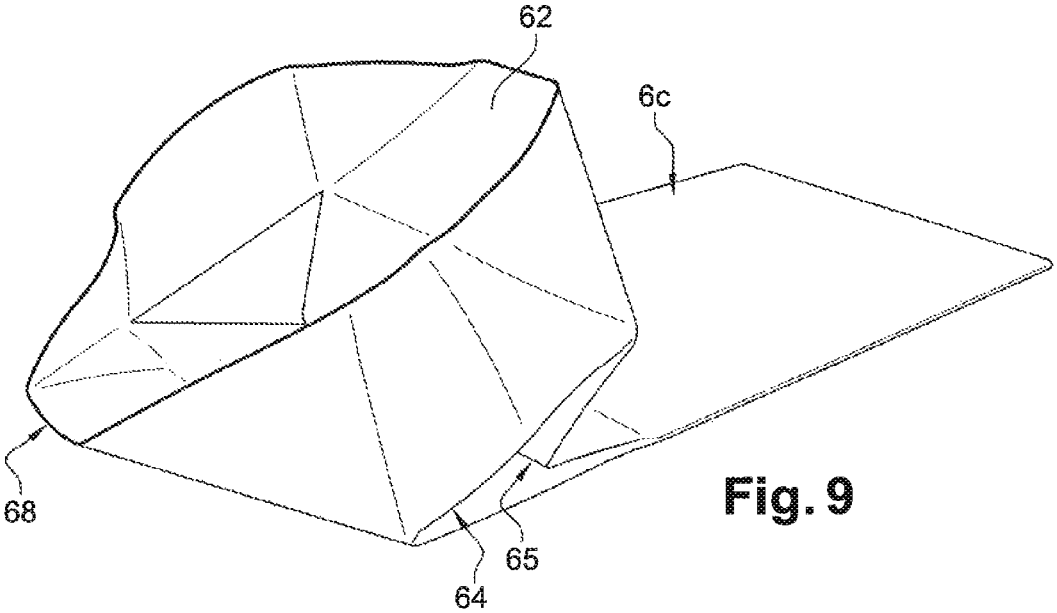
Figure 10:
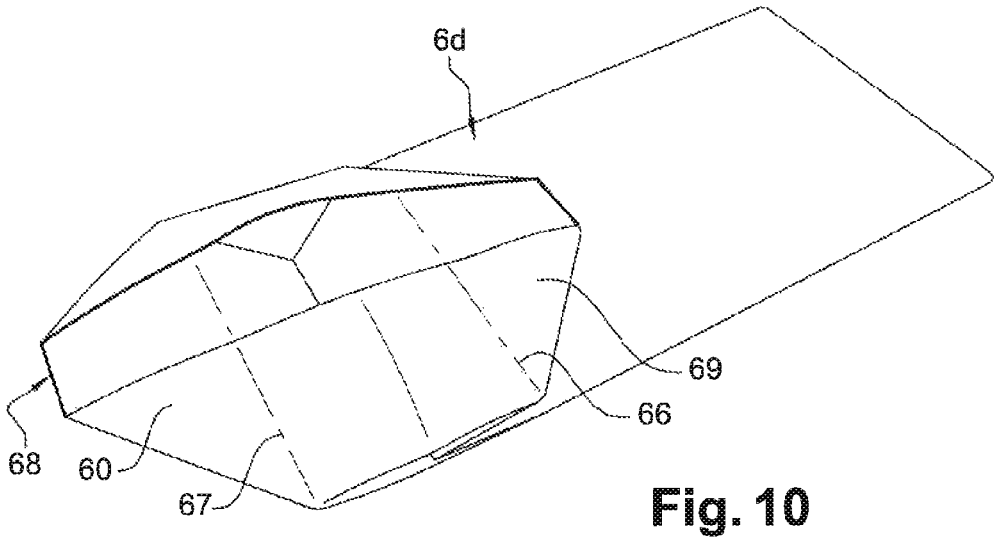

The blank 6*a*, from the cutting device arrives between the first marker roller 510 and the counter roller 511. The first scoring means 51 make a first fold line 64 and a second fold line 65 at a predetermined distance from the first fold line 64, in a direction perpendicular to the bellows 63, as shown by the blank 6*b* represented on FIG. 7. By progressing, the front of the blank 6*b* passes between the drum 50 and the opening roller 54. The lower skin 61 of the blank is sucked against the table 5020 of the second element 502 whilst the upper skin 62 is sucked by the sucker 540 of the opening roller 54. When the upper skin 62 is separated from the lower skin 61, the front pinching means 52 pinch the front edge 68 of the lower skin 61 against the table 5020 to maintain the blank 6*b* on the drum 50 and drive it. When the opening of the bellows 63 is sufficient, the first lateral pinching means 53 pinch the lateral edge of the blank at the junction between the bellows 63 and the lower skin 61 in the alignment of the first fold line 64. Symmetrically, the second lateral pinching means 541 pinch the lateral edge of the blank at the junction between the bellows and the upper skin 62 in the alignment of the first fold line 64. When the blank 6*a* continues its passage between the roller and the drum 50, the lateral pinching means 541, 53 move away from each other, open the blank 6*c* and form a fold on the bellows 63, as shown on FIGS. 8 and 9. The second lateral pinching means 541 then release the blank 6*c* whereas, in the remainder of the movement of the drum 50 which drives the blank 6*c*, spatulas 55 press down the part thus opened towards the centre and the rear. The upper skin 62 is folded towards the rear at the second fold line 65, as shown by the blank 6*d* on FIG. 10.

Figure 11:
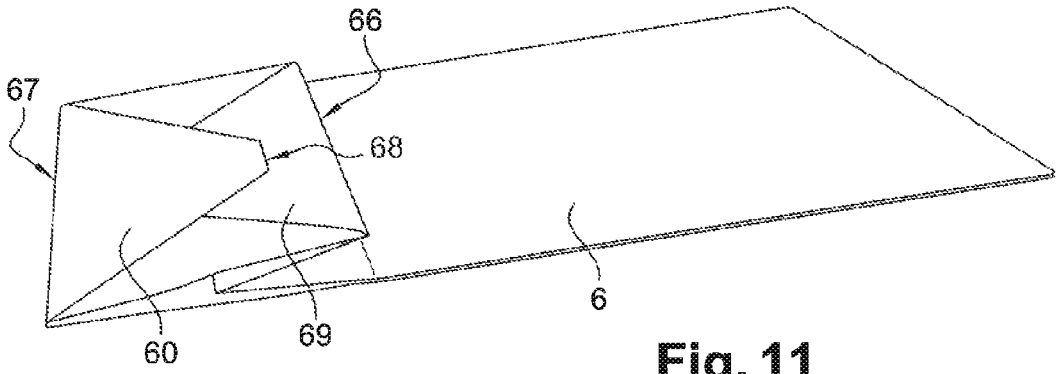

Concerning the operations, the second scoring means 56 mark on the blank 6*d* a third and a fourth transverse fold line 66, 67 on either side of the second fold line 65. The fourth fold line 67 coincides with the first fold line 64. Then, adhesive is applied to the two flaps 60, 69 delimited by these fold lines 66, 67 at the adhesive application station 57. A rear flap 69, beyond the third fold line 66 is pressed down towards the front. The front pinching means 52 release the front flap 60 so that it is pressed down around the fourth fold line 67 onto the rear flap 69 at the press down stations 58 to close the flat bottom and thus form the bag 6, as shown on FIG. 11.

When the format of the bags to be produced is to be changed, the first adjustment means 7 can be acted upon to modify the position of the front pinching means 52 in relation to the second element 502, by rotating the first knob, and therefore the satellite holder of the first reduction gear 71. At the same time, in an automatic manner or manual manner, the relative angular position of the first scoring means 51 can be acted upon to adjust the distance between the front edge 68 of the blank 6*a* and the first fold line 64 which determines the length of the front flap 60.

The second adjustment means 8 can also be acted upon to adjust the distance between the first fold line 64 and the third fold line 66, which determines the width of the flat bottom, by acting on the second scoring means 56. Acting on the second knob, causes the rotation of the satellite holder of the second, of the third and of the fourth reduction gear 82, 83, 84, and therefore the relative angular offset between the second and the third element 502, 503, between the first and the second blade 5101, 5102 of the first marker roller 510 and between the first and the second indent 5111, 5112 of the counter roller 511, and between the third and the fourth blade 5603, 5604 of the second marker roller 560. The position of the second fold line 65 which must be found at mid-distance from the first and the third fold line 64, 66 is also moved by acting on the first scoring means 51.

The invention is not limited to the embodiment described above as an example. The offset between the rotationally driven elements can be introduced by other means, such as the axial offset of a helical-toothed sprocket.

The invention claimed is:

1. A system for making flat bottom bags comprising:

a blank of flattened tubular form;

a machine that engages the blank, the machine comprising:

a rotating drum to drive the blank of flattened tubular form in a direction of advance, wherein the rotating drum comprises:

a first element carrying a front pincher that pinches a front edge of the blank on the drum, in an opening stage, and drives the blank; and a second element carrying a first lateral pincher that pinches lateral edges of the blank at the first fold line, wherein the second element is pivotally mounted in relation to the first element around a rotational axis of the rotating drum; and a first scoring apparatus upstream of the rotating drum that marks on the blank a first fold line transverse to a direction of advance;

a first adjusting apparatus that introduces an offset into a drive movement between the first element and the second element to adjust, during production, while the rotating drum is rotating and the blank is being processed by the machine, both a distance between the front edge and the first fold line and a relative angular position of the front pincher and the first lateral pincher, wherein the first adjusting apparatus comprises a reduction gear allowing an angular offset to be introduced between a first drive of the first element and a second drive of the second element, wherein the reduction gear comprises:

a first planetary gear wheel having a first rotation axis and meshing with a first satellite; and a second planetary gear wheel having a second rotation axis and meshing with a second satellite, wherein the first rotation axis is identical to the second rotation axis and the first satellite and the second satellite are attached to a satellite rotation shaft;

a first reduction ratio of the first wheel and the first satellite is different than a second reduction ratio of the second wheel and the second satellite;

the satellite rotation shaft is rotatably mounted on a satellite holder, which is pivotally mounted around the first rotation;

the first planetary gear receives movement from a motor, and the second planetary gear transmits the movement to one of the first drum element and the second drum element;

wherein modification of a position of the satellite holder introduces an offset into the movement between the first element and the second element and the first element and the second element are angularly offset even when the drum is rotating.

2. The system according to claim 1, wherein the first scoring apparatus marks a second fold line on the blank at a distance from the first fold line, the machine further comprising a second adjusting apparatus that adjusts in operation a distance between the first and the second fold line.

3. The system according to claim 2, the machine further comprising a second scoring apparatus that marks, after the opening stage, a third fold line on the blank, wherein the second adjusting apparatus adjusts a distance between the first fold line and the third fold line so that the second fold line will be at mid-distance between the first fold line and the third fold line.

4. The system according to claim 3, wherein the second scoring apparatus marks a fourth fold line at an identical location on the blank as the first fold line.

5. The system according to claim 1, the machine further comprising a second scoring apparatus that marks, after the opening stage, a third fold line on the blank, wherein the second adjusting apparatus adjusts a distance between the first fold line and the third fold line so that the second fold line will be at mid-distance between the first fold line and the third fold line, wherein the second scoring apparatus comprises a first die on a third element of the drum to mark the third fold line, the third element being pivotally mounted in relation to the second element around the rotational axis of the drum, the second adjusting apparatus determining a relative angular position between the second and the third element.

6. The system according to claim 4, wherein the second scoring apparatus comprises a first die on a third element of the drum to mark the third fold line, the third element being pivotally mounted in relation to the second element around the rotational axis of the drum, the second adjusting apparatus determining a relative angular position between the second element and the third element and the second scoring apparatus comprises a second die on the second element to mark the fourth fold line.

7. The machine according to claim 2, wherein the first scoring apparatus includes a first marker roller and a counter roller, which are counter rotative, and with rotational axes parallel to that of the drum and placed on either side of a path for the blanks, the first marker roller comprising a first blade and a second blade extending parallel to the rotational axis to respectively mark the first and the second fold line by pinching between the blade and the counter roller, the angular difference between the blades being adjustable by the second adjusting apparatus.

8. The machine according to claim 7, wherein the counter roller comprises a first and a second indent on a periphery, the indents extending parallel to the rotational axis of the counter roller, the relative angular position of the indents being adjusted by the second adjusting apparatus so that the blades score fold lines by pushing the blank against the respective indent.

9. The system according to claim 1, the machine further comprising an opening roller to open the blank, the opening roller being placed opposite the drum downstream of the first scoring apparatus, the opening roller being rotative around an axis parallel to that of the drum in an opposite direction, the opening roller comprising a sucker to suck and move away an upper skin of the blank on an outer side of the drum near to the front edge.

* * * * *